US006722374B2

(12) United States Patent
Hwang

(10) Patent No.: US 6,722,374 B2
(45) Date of Patent: Apr. 20, 2004

(54) VIBRATION TYPE COMB USING ULTRASONIC WAVE

(75) Inventor: In Young Hwang, Seoul (KR)

(73) Assignee: Jeung Hoon Park, Seoul (KR)

( * ) Notice: Subject to any disclaimer, the term of this patent is extended or adjusted under 35 U.S.C. 154(b) by 60 days.

(21) Appl. No.: 10/211,389

(22) Filed: Aug. 2, 2002

(65) Prior Publication Data

US 2003/0037793 A1 Feb. 27, 2003

(30) Foreign Application Priority Data

Aug. 27, 2001 (KR) ..... 2001-51904

(51) Int. Cl.[7] ..... A45D 24/00
(52) U.S. Cl. ..... 132/119.1
(58) Field of Search ..... 132/118, 119.1, 132/148, 271; 601/2, 80, 95, 73, 137; 34/96, 97, 98

(56) References Cited

U.S. PATENT DOCUMENTS 3,853,133 A * 12/1974 Komatsu et al. ..... 132/119.1
3,870,056 A * 3/1975 Stemme ..... 132/119.1
3,903,905 A * 9/1975 Tucker ..... 132/118
5,918,607 A * 7/1999 Zucker ..... 132/200

* cited by examiner

*Primary Examiner*—Todd E. Manahan
(74) *Attorney, Agent, or Firm*—Ladas & Parry

(57) ABSTRACT

A vibration type comb includes an ultrasonic wave generator which generates an ultrasonic wave, which is transferred to a vibrator in the comb body through an ultrasonic wave transfer pipe connected to the ultrasonic wave generator. A cover in which first slits are formed in a lower portion of the same in a horizontal direction, is detachably engaged to a lower portion of the body and a comb plate which has one end connected with the vibrator and the other end having second slits formed therein in a horizontal direction, is vibrated such that the second slits move in upward and downward directions between the first slits.

8 Claims, 6 Drawing Sheets

VIBRATION TYPE COMB USING ULTRASONIC WAVE

BACKGROUND OF THE INVENTION

1. Field of the Invention

The present invention relates to a vibration type comb using an ultrasonic wave, and in particular to a vibration type comb using an ultrasonic wave which is capable of forming a curly hair to a straight shape hair when combing hairs using a vibration plate which is vibrated by an ultrasonic wave transferred from an ultrasonic wave generator to a comb.

2. Description of the Background Art

The colored race has a curly hair hereditarily. The blacks often go to a hair shop for wearing an artificial wig purchased in a hair shop to the head for thereby styling hairs and forming a desired hair wave using a hot comb flat iron or pressing comb by straightly forming hairs.

At this time, a work for straightly forming hairs is first performed. In order to straightly form hairs, a hot comb flat iron or pressing comb is generally used.

In the case of the blacks, a curly hair is applied with a certain chemical agent such as a Perm or a gel type oil, etc. before straightly forming hairs due to an inherent characteristic of hairs, and then the hairs are straightly formed using a certain tool such as a hot comb flat iron or pressing comb which maintains a high temperature.

However, the processes for straightly forming a curly hair using a high temperature tool have many problems.

First, since a hot comb flat iron or pressing comb which is heated to a high temperature is used, a user's hair and skins near styling hairs may be damaged due to a high temperature heat.

Second, a chemical product for hairs is molten by a hot comb flat iron or pressing comb and is stuck to a portion between slits of a comb, so that when a hair is hold between neighboring slits of a comb or combed, the hairs may be cut or taken out.

Third, a hair stylist may be damaged by a high temperature tool due to carelessness for thereby causing a safety problem.

In the case that a hair is formed in a straight shape in a hair shop, the hairs must be straightly formed again after 2~3 weeks for thereby maintaining a desired hair style. In addition, in the case that the hairs are combed everyday using various types of combs or brushes at home, a work for straightly forming hairs must be first performed in order to obtain a desired hair style.

SUMMARY OF THE INVENTION

Accordingly, it is an object of the present invention to provide a vibration type comb using an ultrasonic wave which is capable of shaping a curly hair to a straightly shape using an ultrasonic wave and implementing various types of waves in hairs.

It is another object of the present invention to provide a vibration type comb using an ultrasonic wave which is capable of implementing an easier hair caring work in such a manner that a user directly straightly form hairs and then form a wave form hair and decreasing a hair styling cost without using a hair shop.

It is another object of the present invention to provide a vibration type comb using an ultrasonic wave which is capable of sterilizing mold bacteria which live in hairs by emitting an ultrasonic wave when combing hairs.

To achieve the above objects, there is provided a vibration type comb using an ultrasonic wave which includes an ultrasonic wave generator which generates an ultrasonic wave, a body which includes a vibrator vibrated by an ultrasonic wave transferred through an ultrasonic wave transfer pipe connected to the ultrasonic wave generator and a handle which is extended from one side of the same, a cover in which first slits are formed in a lower portion of the same in a horizontal direction, with said cover being detachably engaged to a lower portion of the body, and a comb plate which includes one end connected with the vibrator and the other end having second slits formed therein in a horizontal direction, with the second slits being vibrated in upward and downward directions between the first slits.

In the present invention, a bracket having a longitudinal hole is fixed in an upper portion of the vibrator, and a fixing shaft fixed at an inner side surface of the body is inserted into the longitudinal hole.

In addition, a latch is formed in an opened upper portion of the cover to be opposite each other, and a latch groove to which the latch is detachably engaged is formed din the body.

There is further provided a fan which is installed in the body and sucks an external air from an upper portion of the body and discharges in the direction of the second slits, and a heater which heats an external air sucked by the fan.

There is still further provided a steel wire net which is installed in the body being opposite to the fan for thereby filtering a foreign substance when sucking an external air.

The ultrasonic wave generator includes a first switch which connects or disconnects a commercial power supplied from the outside to the ultrasonic wave generator, and a second switch which adjusts an intensity of the ultrasonic wave generated by the ultrasonic wave generator.

The handle includes a switch which connects or disconnects a commercial power supplied to the heater and fan and controls an ultrasonic wave which is transferred from the ultrasonic wave generator to the vibrator through the ultrasonic wave transfer pipe.

A comb plate which is connected with the vibrator and vibrates, is formed in a flat shape.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The vibration type comb using an ultrasonic wave according to the present invention will be explained with reference to the accompanying drawings.

Figure 1:
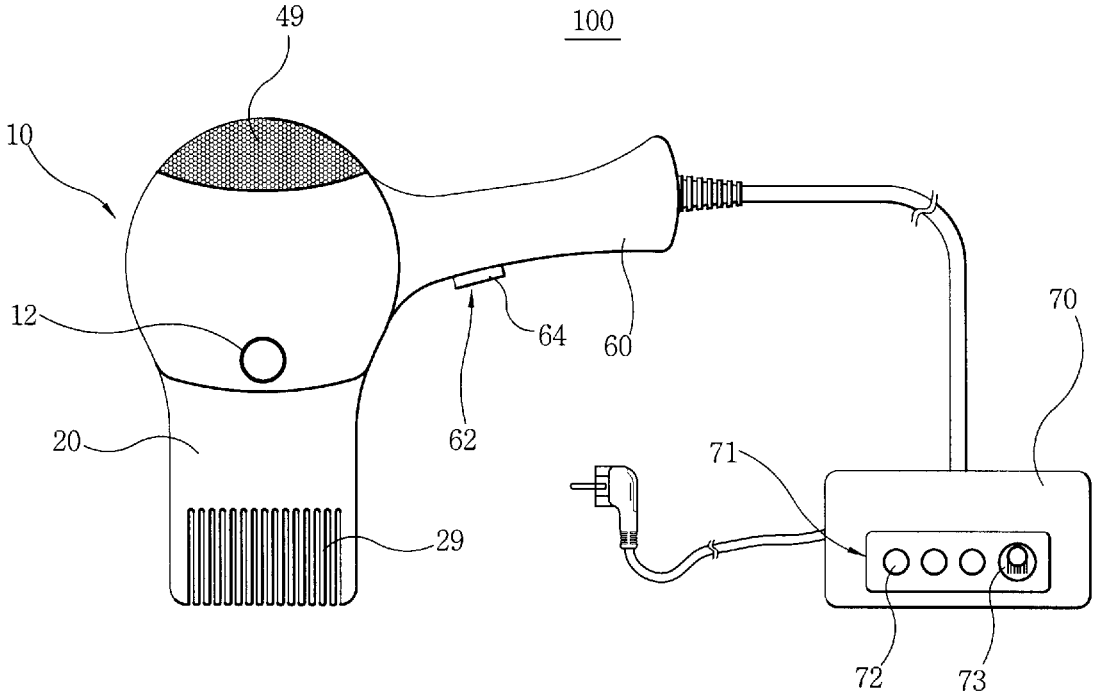
FIG. 1 is a side view illustrating a vibration type comb using an ultrasonic wave according to the present invention.
Figure 2:
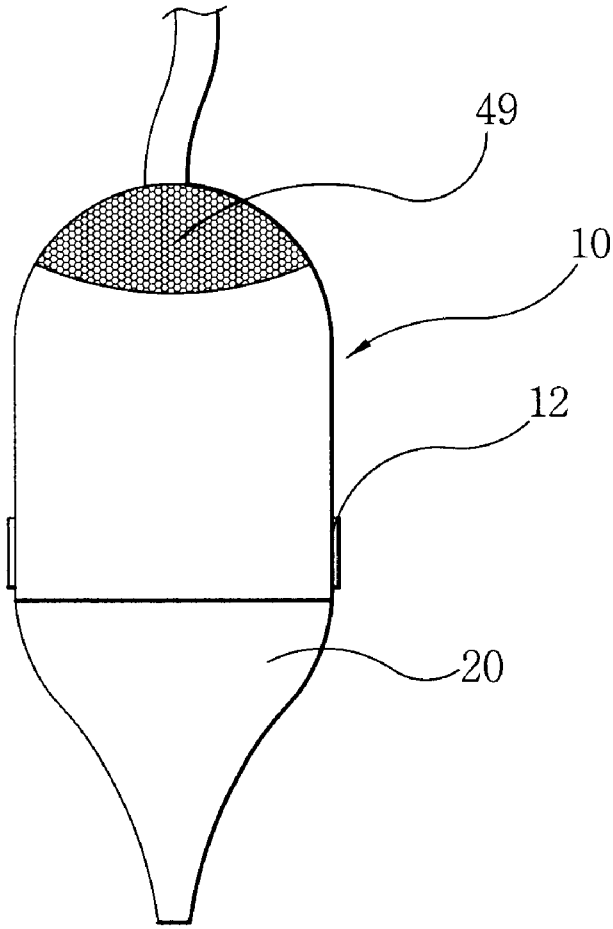
FIG. 2 is a front view illustrating a vibration type comb using an ultrasonic wave of FIG. 1 according to the present invention.
Figure 3:
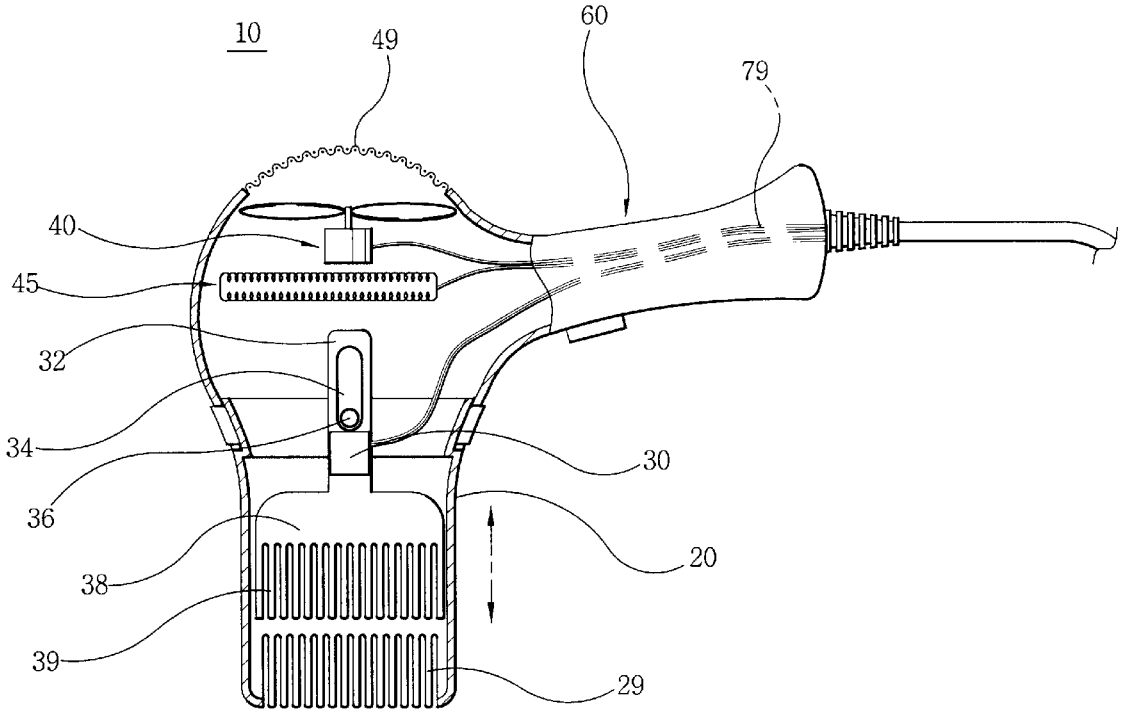
FIG. 3 is a cross-sectional view illustrating a vibration type comb using an ultrasonic wave of FIG. 1 according to the present invention.
Figure 4:
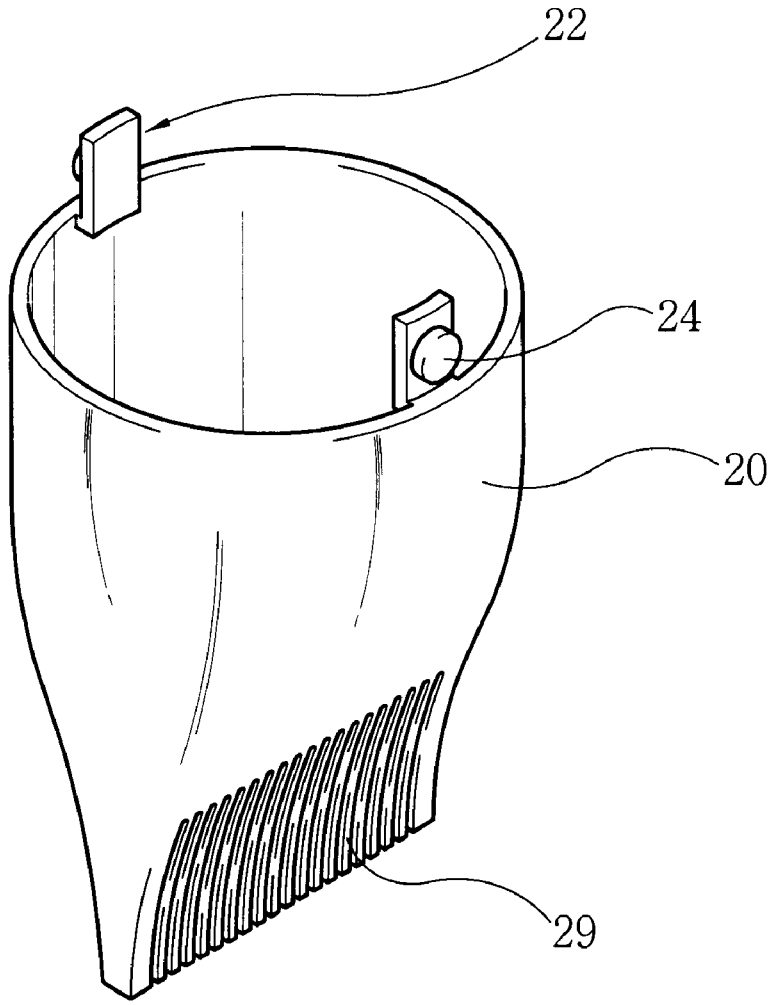
FIG. 4 is a perspective view illustrating a cover of an ultrasonic wave vibration type comb of FIG. 1 according to the present invention.
Figure 5:
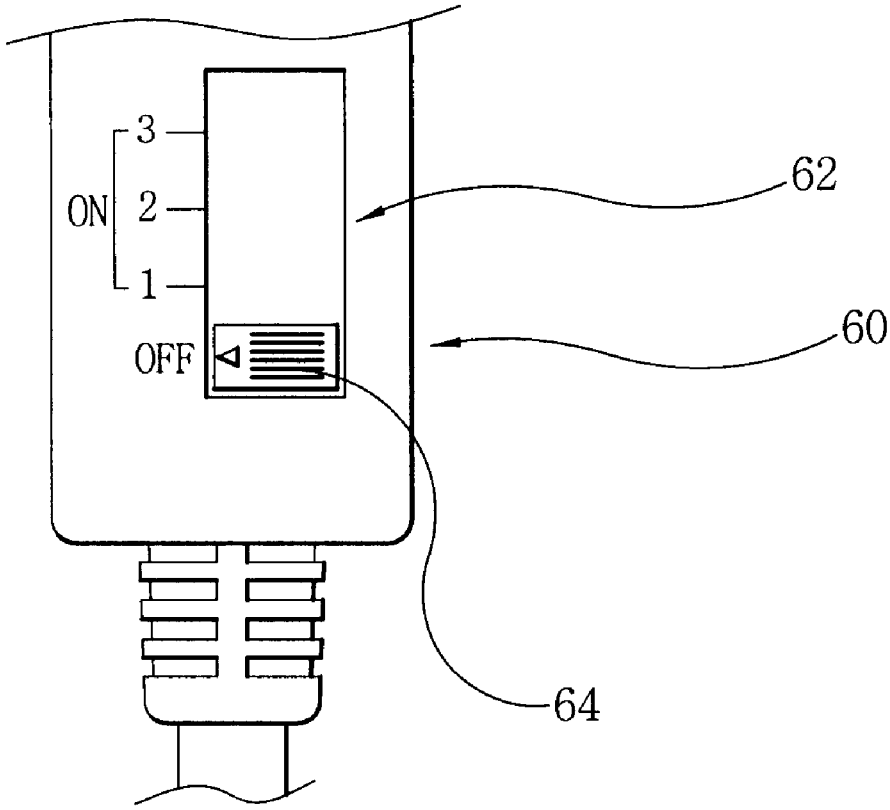
FIG. 5 is a detailed view illustrating a controlled installed in a handle of an ultrasonic wave vibration type comb of FIG. 1 according to the present invention.

FIG. 1 is a side view illustrating a vibration type comb using an ultrasonic wave according to the present invention, FIG. 2 is a front view illustrating a comb of FIG. 1, FIG. 3 is a cross-sectional view illustrating a comb of FIG. 1, FIG. 4 is a perspective view illustrating a cover of FIG. 1, and FIG. 5 is a detailed view illustrating a controlled of FIG. 1.

As shown in FIG. 1, a vibration type comb 100 using an ultrasonic wave according to the present invention includes an ultrasonic wave generator 70 which generates an ultrasonic wave, and a body 10 which performs a combing operation using a comb vibrating by an ultrasonic wave transferred from the ultrasonic wave generator 70.

As shown in FIG. 3, in the body 10, a comb-shaped cover 20 is detachably engaged to a front end of the same, and a handle 60 is formed in one side surface, and a steel wire net 49 is formed in a rear end of the same for preventing a foreign substance form being introduced into the interior of the body 10 when an external air is flown thereinto.

The body 10 includes a vibrator 30 connected with an end portion of an ultrasonic wave transfer pipe 79 which transfers an ultrasonic wave from the ultrasonic wave generator 70, a fan 40 for sucking an external air into the body 10 through the steel wire net 49, and a coil type heater 45 installed between the fan 40 and the vibrator 30.

A bracket 32 having a longitudinal hole 34 is fixed in a rear end of the vibrator 30 in order for the vibrator 30 to vibrates in a longitudinal direction of the bracket 32, and a fixing shaft 36 fixed to an inner side surface of the body is inserted into the longitudinal hole 34.

A comb-shaped comb plate 38 which vibrates in forward and backward directions of the body 10 by the vibration of the vibrator 30 is fixed at a front end of the vibrator 30, and a plurality of first slits 39 are formed in a front end of the comb plate 38 with each slit being formed at a certain length in a longitudinal direction in parallel.

As shown in FIGS. 3 and 4, the cover 20 is detachably engaged to a front end of the body 10. The cover 20 includes an opened rear end and is engaged to a front end of the body 10. The front end of the cover 20 is gradually thinned in a certain direction for thereby being formed in a plate shape. A plurality of second slits 29 are formed in a front end of the cover 20 in a direction from the front end to the rear end in a comb shape in a horizontal direction.

As shown in FIG. 4, two latches 22 are formed in an opposite direction each other in an opened upper end of the cover 20 in which a circular protrusion 24 is formed in an outward direction, with the circular protrusion 24 being detachably engaged to a latch groove 12 opposite to a front end of the body 10.

At this time, in order to separate the cover 20 from the body 10, the protrusion 24 of the latch 22 is inwardly pressurized from the external direction, and then the cover 20 is pulled out in the opposite direction with respect to the body 10.

As shown in FIG. 3, in the case that the cover 20 is engaged to the front end of the body 10, the comb plate 38 received in the interior of the body 10 is positioned in a state that the comb plate 38 is inserted in the interior of the cover 20, and the first slits 39 formed in the comb plate 38 are matched with the second slits 29 formed in the cover 20. When the comb plate 38 is vibrated in the upper and lower directions in the drawings by the vibrator 30, the first slits 39 of the comb plate 38 are vibrated in the forward and backward directions in a state that the first slits 39 are matched with the second slits 29.

As shown in FIG. 1, the ultrasonic wave generator 70 includes a first power supply unit which supplies power, a second power supply unit which rectifies and smoothes the inputted power after increasing the power level based on the number of windings and then which supplies the power, a plurality of switches, a controller for controlling the signals inputted from the switches, and an ultrasonic wave oscillator which generates a high frequency electric vibration in accordance with an ultrasonic generation control signal of the controller. Since the above construction of the same is well known art, the detailed description thereon will be omitted.

There is further provided an ultrasonic wave transfer pipe 79 which transfers an ultrasonic wave from the ultrasonic wave oscillator of the ultrasonic wave generator to the vibrator 30 of the body 10.

In addition, the switch 71 of the ultrasonic wave generator 70 includes a first switch 72 which turned on/off the power externally supplied to the ultrasonic wave generator 70 through a plug, and a second switch 73 for adjusting the intensity of the ultrasonic wave.

As shown in FIG. 5, a controller 62 is installed in the handle 60 of the body 10 for controlling the operation of the body 10, and in a state that the switch 64 of the controller 62 is in OFF state, the ultrasonic wave transferred trough the ultrasonic wave transfer pipe 79 is disconnected, and the fan 40 is stopped, and the supply of the current to the heater 45 is disconnected. In a state that the switch 64 is ON state, a constant ultrasonic wave is transferred through the ultrasonic wave transfer pipe 79, and the fan 40 is driven, and the voltage supplied to the heater 45 is changed based on the position of the switch 64 of the controller 62. Therefore, the amount of heat generated by the heater 45 is controlled.

The operation of the vibration type comb using an ultrasonic wave according to the present invention will be described with reference to the accompanying drawings.

As shown in FIG. 3, in the cover 20 is engaged to the body 10, in the case that the first switch 72 of the ultrasonic wave generator 70 is switched to ON state, and then the switch 64 of the controller 62 is switched to OFF state, the ultrasonic wave generated by the ultrasonic wave generator 70 is transferred to the vibrator 30 in the interior of the body 10 through the ultrasonic wave transfer pipe 79. The vibrator 30 is vibrated in the forward and backward directions of the body 10(Upward and downward directions in FIG. 3).

The vibrator 30 is vibrated in the forward and backward directions by the longitudinal hole 34 of the bracket 32 fixed to an inner side surface of the body 10, and the comb plate 38 is vibrated in the forward and backward directions by the vibration of the vibrator 30. As the first slits 39 of the comb plate 38 is vibrated in the forward and backward directions along the second slits 29 of the cover 20, in the case that when a combing operation is performed using the second slits 29 of the cover 20, the curled hairs are uncurled by the first slits 39 of the comb plate 38 which vibrates between the second slits 29 of the cover 20.

In addition, in a state that the switch 64 of the controller 62 formed in an outer side surface of the handle 60 is ON, the heat is generated by the heater 45, and as the fan 40 is rotated, an external air is sucked into the interior of the body 10 through the steel line net 49 formed in the rear end of the body 10 and is discharged through the second lines 29 of the cover 20, so that the hairs are dried and hardened while the hairs are being combed, whereby the curled hairs are changed to a straight shape.

Figure 6:
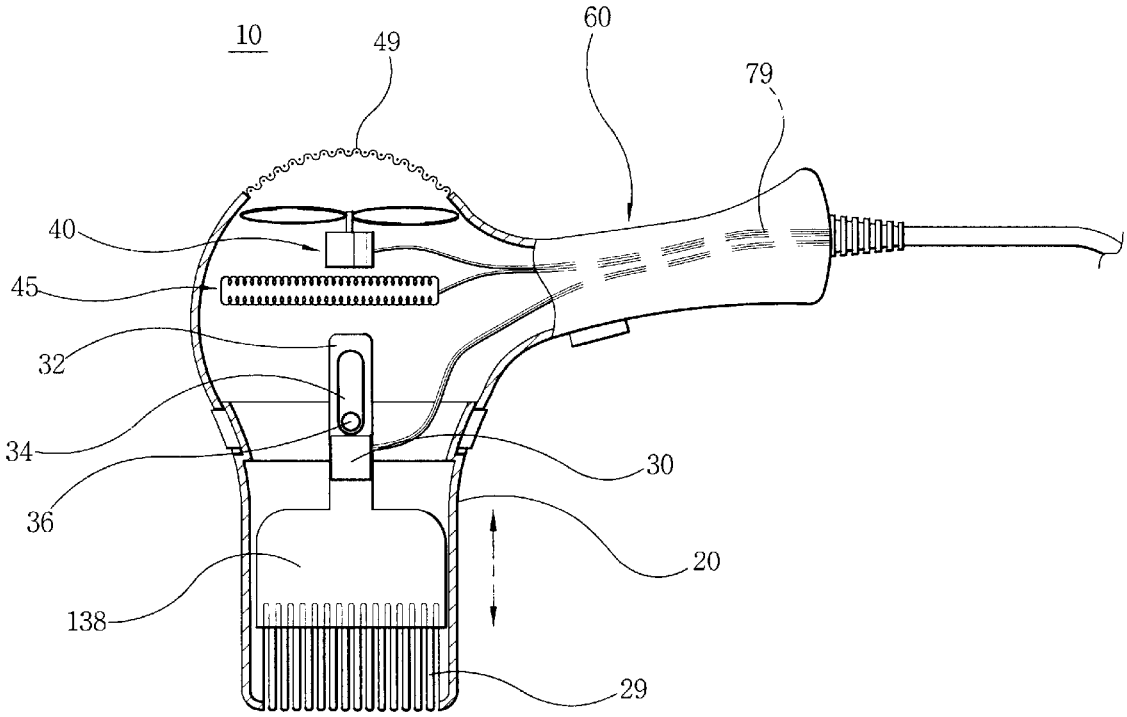
FIG. 6 is a cross-sectional view illustrating a comb in which another comb plate formed by modifying the comb plate of FIG. 1 is installed according to the present invention.

As shown in FIG. 6, in the case that the slits are not formed in the comb plate, the comb plate 138 is fixed to the vibrator 30 and is vibrated, so that it is possible to change the curled hairs to a straight shape. At this time, since the cover 20 in which the second slits 29 are formed, the body 10 in which the heater 45 and the handle 60 are provided, and the ultrasonic transfer pipe 79 which transfers an ultrasonic wave to the vibrator 30 are constituted in the same construction as FIG. 3, the description thereon will be omitted.

In addition, a horn(not shown) may be further installed in order for an ultrasonic wave which is transferred through an ultrasonic wave transfer pipe to be discharged toward the slits of the cover. Here, the above horn may be easily installed in a conventional method by a person who has a skill in the ultrasonic wave field.

The vibration type comb using an ultrasonic wave according to the present invention is capable of easily combing and straightly forming a tangled hair or curled hairs based on a vibration of a vibrator during a transfer of ultrasonic waves when combing hairs.

In addition, in the present invention, when uniformly arranging and combing the hairs or curled hairs, as a high temperature air is supplied to the hairs, it is possible to form a certain wave in the straightly formed hairs.

As the ultrasonic wave is transferred to the hairs, it is possible to sterilize mold bacteria which live in the hairs.

When a foreign substance is accumulated in the slits of the cover, it is possible to easily exchange or wash by simply disassembling the cover from the body.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A vibration type comb using an ultrasonic wave, comprising:

an ultrasonic wave generator which generates an ultrasonic wave;

a body which includes a vibrator vibrated by an ultrasonic wave transferred through an ultrasonic wave transfer pipe connected to the ultrasonic wave generator and a handle which is extended from one side of the same;

a cover in which first slits are formed in a lower portion of the same in a horizontal direction, with said cover being detachably engaged to a lower portion of the body; and a comb plate which includes one end connected with the vibrator and the other end having second slits formed therein in a horizontal direction, with the second slits being vibrated in upward and downward directions between the first slits.

2. The comb of claim 1, wherein a bracket having a longitudinal hole is fixed in an upper portion of the vibrator, and a fixing shaft fixed at an inner side surface of the body is inserted into the longitudinal hole.

3. The comb of either claim 1 or claim 2, wherein a latch is formed in an opened upper portion of the cover to be opposite each other, and a latch groove to which the latch is detachably engaged is formed din the body.

4. The comb of either claim 1 or claim 2, further comprising:

a fan which is installed in the body and sucks an external air from an upper portion of the body and discharges in the direction of the second slits; and a heater which heats an external air sucked by the fan.

5. The comb of claim 4, further comprising:

a steel wire net which is installed in the body being opposite to the fan for thereby filtering a foreign substance when sucking an external air.

6. The comb of claim 4, wherein said handle includes a switch which connects or disconnects a commercial power supplied to the heater and fan and controls an ultrasonic wave which is transferred from the ultrasonic wave generator to the vibrator through the ultrasonic wave transfer pipe.

7. The comb of claim 1, wherein said ultrasonic wave generator includes:

a first switch which connects or disconnects a commercial power supplied from the outside to the ultrasonic wave generator; and a second switch which adjusts an intensity of the ultrasonic wave generated by the ultrasonic wave generator.

8. The comb of claim 1, wherein a comb plate which is connected with the vibrator and vibrates, is formed in a flat shape.

* * * * *